United States Patent [19]

Hesse et al.

[11] 4,125,055

[45] Nov. 14, 1978

[54] CONTROL SWITCH FOR AMMUNITION SELECTION FOR WEAPONS

[75] Inventors: Gunther Hesse, Wolfershausen; Manfred Strassnitzki, Vellmar; Helmut von Dolsperg, Hann.-Münden, all of Germany

[73] Assignee: Wegmann & Co., Kassel, Germany

[21] Appl. No.: 776,054

[22] Filed: Mar. 9, 1977

[30] Foreign Application Priority Data

May 5, 1976 [DE] Fed. Rep. of Germany ..... 2619783

[51] Int. Cl.[2] ..... F41G 11/00

[52] U.S. Cl. ..... 89/33 SF; 235/408; 307/247 R; 307/291

[58] Field of Search ..... 89/33 SF, 41 ME, 135; 235/61.5 E; 307/247 R, 291

[56] References Cited

U.S. PATENT DOCUMENTS 3,739,152 6/1973 Frohock et al. ..... 235/61.5 E

*Primary Examiner*—Stephen C. Bentley

*Attorney, Agent, or Firm*—Sprung, Felfe, Horn, Lynch & Kramer

[57] ABSTRACT

A control switch for the input of a signal into a fire direction computer to select the ammunition for weapons from which a plurality of types of ammunition can be selectively fired. The control switch includes a plurality of switches each corresponding to one type of ammunition. A plurality of flip-flops, each corresponding to one switch, each have a set input connected to the associated switch and is settable thereby and each has at least one reset input connected to the remaining switches and is resettable by any one thereof, whereby only one flip-flop is set at a given time corresponding to the selected ammunition resulting in the output thereof providing the only input signal to the fire direction computer.

6 Claims, 1 Drawing Figure

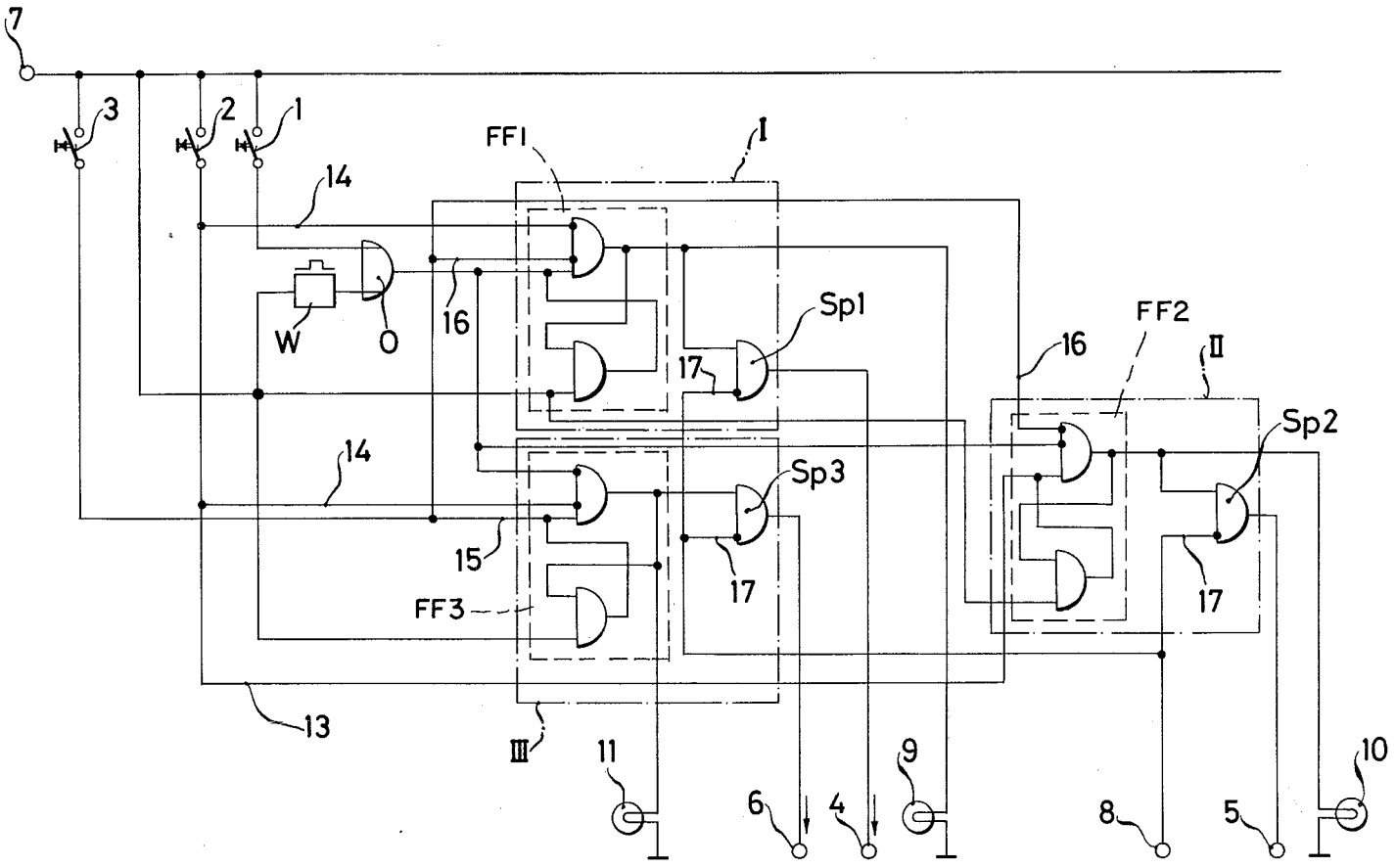
Sp2
II
FF2
16
17
10
5
8
9
Sp1
Sp3
1
FF1
17
17
4
6
11
III
16
15
FF3
O
W
14
14
13
1
2
3
7

CONTROL SWITCH FOR AMMUNITION SELECTION FOR WEAPONS

BACKGROUND OF THE INVENTION

The present invention relates to a control switch for the input of a signal into a fire direction computer for ammunition selection.

Out of weapons, especially heavy weapons, very often various types of ammunition are fired. If the weapon is controlled by a fire direction computer, the fire direction computer must have a signal input applied thereto, signaling which type of ammunition is being fired at that moment. Moreover, it must be made sure, that even in a fast or frequent change of types of ammunition, the fire direction computer is always given the matching signal of the selected ammunition. If a step switch is used, and if more than two types of ammunition are intended to be used, when the operator changes from type 1 to 3, the type 2 ammunition will be temporarily switched in, which means loss of time and subsequently, initially the weapon is faced with inapplicable gun sight data. Combat vehicles often have, in addition to a main weapon, a secondary weapon which is also controlled by a fire direction computer. When the fire direction computer is used for the secondary weapon, the input signal for the selected ammunition for the main weapon has to be kept isolated from the fire direction computer.

SUMMARY OF THE INVENTION

The main object of the invention is to solve the first problem by providing a control switch according to the invention which always feeds into the fire direction computer the signal for the selected type of ammunition, and that for ($n$) different types of ammunition, each type of ammunition is provided with a flip-flop circuit with ($n-1$) canceling or reset inputs. The canceling input of the different circuit groups I, II, III (types of ammunition) is also in connection with the charging or setting input of the flip-flop for another type of ammunition.

Another object is to provide, contrary to switching by a step switch, a control switch where the switching is always followed, without observing any sequence, immediately after a new type of ammunition is put in, independent from the number of types of ammunitions, whereby the fire direction computer gets the correct input immediately and the time from target acquisition to firing is shortened. A further object is to solve the second problem of switching in a secondary weapon by providing a circuit, according to the invention, where each flip-flop has an AND-NOT gate with each having a canceling input connected to the outside. These canceling inputs can get, via a further input line, blocking signals from the fire direction computer, so that the circuit groups for the fire direction computer can be switched off, e.g., when the fire direction computer is not used for the main weapon, but for a secondary one, such as a machine gun.

The objects of the invention are achieved by the control switch of the present invention which applies an input signal to a fire direction computer to indicate the selection of one of a plurality of types of ammunition which can be selectively fired. The control switch includes a plurality of actuatable switches, such as push-buttons, each corresponding to one type of ammunition and a plurality of flip-flops, each corresponding to one switch. Each flip-flop has a setting input connected to its associated switch and is settable in response to the actuation of the switch. Each flip-flop also has at least one resetting input connected to the remaining switches and is resettable in response to the actuation of any one thereof. Thus, only one flip-flop is set at a given time, producing only one input signal at a time to the fire direction computer indicating the desired ammunition.

In a further embodiment, each of the outputs of the flip-flops can be blocked by means responsive to a blocking signal from the fire direction computer. The blocking disenables the output from the set flip-flop for the duration of the blocking signal, without resetting the set slip-flop. In the preferred embodiment, this means includes a plurality of AND-NOT gates, each corresponding to one flip-flop and each having a non-inverting input connected to the output of its associated flip-flop and the inverting input receptive of the blocking signal.

Additionally, a pulsing circuit is provided for one given flip-flop to initialize the control switch to set the given flip-flop and reset the remaining flip-flops in response to the energizing of the circuit.

Indicator lamps are also provided for connection to the output of each flip-flop to indicate when the flip-flop is set.

Having in mind the above and other objects that will be obvious from an understanding of the disclosure, the present invention comprises a combination and arrangement of parts illustrated in the presently preferred embodiment of the invention which is hereinafter set forth in sufficinet detail to enable those persons skilled in the art to clearly understand the function, operation, construction and advantages of it when read in conjunction whith the accompanying drawing.

BRIEF DESCRIPTION OF THE DRAWING

The FIGURE is a schematic diagram of the circuit of the control switch according to the present invention.

DETAILED DESCRIPTION OF THE PREFERRED EMBODIMENT

An example of the object of the invention is shown in the FIGURE, where it is assumed, that three different types of ammunition are selectively fired, and the number ($n$) consequently equals 3. Correspondingly, the circuit scheme contains three circuit groups of the same kind I, II and III, which are each framed in the FIGURE by a dotted line. Three push button switches 1, 2 and 3 serve to select the corresponding type of ammunition. Each of the three circuit groups comprise a flip-flop FF1, FF2 or FF3 with each having one charging or setting input and two canceling or resetting inputs. In the example, each flip-flop includes an AND-NOT gate each of which is an AND gate having one charge or non-inverting input and two canceling or inverting inputs, and one AND gate. One input of the AND gate is connected with the output of the AND-NOT gate and the second input of the AND gate is connected to the supply voltage 7. Furthermore, if the transmission of the signal to the computer should be blocked, and the computer is used for a secondary weapon, e.g., for a machine gun, each circuit group contains an AND-NOT gate Sp1, Sp2 or Sp3, where the input is connected with the output of the respective flip-flop FF1, FF2 and FF3. The outputs of the gates Sp1, Sp2 or Sp3 lead to the inputs 4, 5 or 6 of the computer and alternatively provide the input signal indicating the type of ammunition selected. The blocking inputs are connected via input 8 with the ammunition selector switch MG (not shown), and get a blocking signal at the inverting input, when the secondary weapon is used. Each flip-flop output is connected with a signal lamp 9, 10 or 11.

Additionally, one of the groups can have further an initializing circuit as shown in the FIGURE for group I, including an OR gate O, connected in series, of which one input is connected to pushbutton 1, for type ammunition 1 and the second input through wiper or pulser W which is connected to the supply voltage 7 and which pulses the OR gate O when the circuit is energized.

In operation the circuit operates as follows, as explained hereinafter.

By applying the supply voltage 7, automatically a voltage or pulse is sent to the input of the flip-flop FF1 via wiper W, and the OR gate O. As there are no clearing signals at the flip-flops, FF1 is set.

The control lamp 9 for the type of ammunition corresponding to FF1 lights up, and provided that Sp1 is not blocked, the signal of ammunition type 1 goes via 4 to the computer. If the ammunition selection changes, e.g., the pushbutton 2 is pressed for the ammunition type 2, a charge or setting signal goes via circuit line 13 to the charging input of FF2 and at the same time a clearing signal goes via circuit line 14 to the canceling or resetting inputs of FF1 and FF3. With that FF1 is canceled or reset and FF2 is charged or set, the signal lamp 10 for ammunition type 2 lights up and the signal for ammunition type 2 goes via 5 to the computer. Correspondingly, the same process takes place when pushbutton 3 is pressed for ammunition type 3. In this case, the charge signal goes via circuit line 15 to the charge input of FF3 and at the same time canceling signals go via the circuit line 16 to FF1 and FF2. The control lamp 11 lights up and the signal goes via 6 to the computer.

If under any condition of the switching the secondary weapon, e.g., MG is selected, then a blocking signal goes via a weapon selector switch (not shown) to the computer, that goes from input 8 via circuit line 17 to the blocking inputs of Sp1, Sp2 and Sp3. These gates thus have their outputs blocked, without canceling or resetting the respectively charged FF1, FF2 or FF3. The signal from the set flip-flop is not passed to the computer, but the signal lamp of the selected ammunition type stays on. As soon as the selection of the ammunition is switched back to the main weapon and the blocking signal is removed, the computer also gets again the signal of the respectively selected ammunition type from the one flip-flop that is set.

While the preferred embodiment has been shown by way of example in the drawing, it will be understood that the invention is in no way limited to this embodiment.

What is claimed is:

1. A control switch for applying an input signal to a fire direction computer to indicate the selection of one of a plurality of types of ammunition which can be selectively fired, the control switch comprising:

a plurality of actuatable switches each corresponding to one type of ammunition; and a plurality of flip-flops each corresponding to one switch and each having a setting input connected to the associated switch and settable in response to the actuation thereof and each having at least one resetting input connected to the remaining switches and resettable in response to the actuation of any one thereof;

whereby only one flip-flop is set at a given time and only one flip-flop output applies an input signal to the fire direction computer indicating the desired ammunition.

2. A control switch according to claim 1, further comprising means connected to the output of each flip-flop and responsive to a blocking signal from the fire direction computer for disenabling the output from the set flip-flop for the duration of the blocking signal without resetting the set flip-flop.

3. A control switch according to claim 2, wherein said means for disenabling comprises a plurality of AND-NOT gates each corresponding to one flip-flop and each having a non-inverting input connected to the ouput of the corresponding flip-flop and each having an inverting input receptive of the blocking signal from the fire direction computer.

4. A control switch according to claim 3, further comprising a pulsing circuit responsive to the energizing of the control switch for initializing the control switch to set a given flip-flop and reset the remaining flip-flops.

5. A control switch according to claim 4 wherein each of the plurality of switches conprises a pushbutton switch.

6. A control switch according to claim 5, further comprising a plurality in indicator lamps each connected to the output of one flip-flop to indicate when same is set.

* * * * *